United States Patent [19]

Okuda et al.

[11] Patent Number: 4,697,397

[45] Date of Patent: Oct. 6, 1987

[54] TRUSSED GIRDER, ROOF FRAMING USING THE TRUSSED GIRDER AND METHOD OF CONSTRUCTING THE ROOF FRAMING OF A BUILDING USING THE TRUSSED GIRDER

[75] Inventors: Shuji Okuda; Hideo Shimomura; Kusuo Honda; Masato Kawaguchi; Yasuo Kuno; Takenori Kumagai; Nobuo Kato, all of Tokyo, Japan

[73] Assignees: Shimizu Construction Co. Ltd., Tokyo; Kawasaki Steel Corporation, Hyogo, both of Japan

[21] Appl. No.: 893,625

[22] Filed: Aug. 6, 1986

[30] Foreign Application Priority Data

Aug. 10, 1985 [JP] Japan ..... 60-175996
Aug. 10, 1985 [JP] Japan ..... 60-175997

[51] Int. Cl.[4] ..... E04B 1/24; E04C 3/10
[52] U.S. Cl. ..... 52/223 R; 52/745
[58] Field of Search ..... 52/223 R, 745, 66, 641, 52/644

[56] References Cited

U.S. PATENT DOCUMENTS

| | | | |
|---|---|---|---|
| 2,603,171 | 7/1952 | Smith | 52/66 |
| 3,140,764 | 7/1964 | Cheskin | 52/223 R |
| 3,424,179 | 1/1969 | Minot | 52/63 X |
| 4,144,686 | 3/1979 | Gold | 52/223 R |
| 4,187,652 | 2/1980 | Bobrovnikov et al. | 52/223 R |

FOREIGN PATENT DOCUMENTS

| | | | |
|---|---|---|---|
| 2342049 | 3/1975 | Fed. Rep. of Germany | 52/223 |
| 644254 | 10/1950 | United Kingdom | 52/745 |
| 519526 | 7/1976 | U.S.S.R. | 52/641 |

*Primary Examiner*—Alfred C. Perham
*Attorney, Agent, or Firm*—Kane, Dalsimer, Kane, Sullivan and Kurucz

[57] ABSTRACT

Trussed girder, roof framing using the trussed girder and method of constructing the roof framing of a building using the trussed girder. In the trussed girder, an upper chord and a lower chord are jointed through lattice members. The trussed girder includes: a prestressing steel member; and an attaching mechanism for attaching the prestressing steel member to at least one of both the upper and lower chords to longitudinally extend under tension for providing prestress to the trussed girder.

13 Claims, 11 Drawing Figures

TRUSSED GIRDER, ROOF FRAMING USING THE TRUSSED GIRDER AND METHOD OF CONSTRUCTING THE ROOF FRAMING OF A BUILDING USING THE TRUSSED GIRDER

BACKGROUND OF THE INVENTION

The present invention relates to a trussed girder, a roof framing using the trussed girder and a method of constructing the roof framing of a building using the trussed girder.

For long span roof framings, there are conventionally used various structures such as a trussed structure, shell structure, suspended structure and pneumatic structure. Among these structures, the trussed roof framing structure using parallel long span trussed girders are widely used since it does not increase ceiling space not used and provides ease in expansion of the building.

However, such long span trussed girders as well as long span trussed girders for other use have drawbacks in that when the span is extra large, deflection thereof becomes considerably large and the trussed girder take larger part of the total weight of the building, so that cost performance is reduced.

Further, in construction of such a long spanned trussed roof framing, according to the prior art, structural elements forming outer walls of the building are erected, and then a roof framing which is prefabricated on the ground is craned and bridged between the structural elements.

However, such a long spanned trussed roof framing is disadvantageous in that it necessitates an extra large crane for lifting the roof framing, and in that indoor temporary works for the construction of the roof are rather laborious. These result in increases in construction term and cost.

SUMMARY OF THE INVENTION

Accordingly, it is an object of the present invention to provide a trussed girder which enables to reduce its weight with relatively small deflection, so that cost performance is enhanced.

It is another object of the present invention to provide a roof framing using the trussed girder with relatively high cost performance.

It is still another object of the present invention to provide a method of constructing a roof framing of a building using trussed girders above mentioned, in which the construction term and cost of the roof framing are reduced.

With this and other objects in view, one aspect of the present invention is directed to a trussed girder in which an upper chord and a lower chord are jointed through lattice members, comprising: a prestressing steel member; and attaching means for attaching the prestressing steel member to at least one of both the upper and lower chord to longitudinally extend under tension for providing prestress to the trussed girder.

Preferably, the trussed girder includes a sheath member, mounted on the at least one chord to extend longitudinally, the prestressing steel member passing through the sheath member. With the sheath, the prestressing steel member is protected against stress concentration and corrosion.

In another preferred from, the attaching means may include: a pair of engaging members jointed to opposite ends of the prestressing steel member; and connecting means for connecting the engaging members to the at least one chord so that the tension of the prestressing steel member is adjustable. With such a construction, an appropriate prestressing may be applied to the prestressing steel member.

In still another preferred form, the at least one chord comprising: an upper flange; a lower flange; a web joining the upper and lower flanges to define a pair of parallel channel portions; and ribs mounted thereon to partition the channel portions, and wherein the sheath member is mounted to the at least one chord in the number of two so that each sheath member is disposed in a corresponding channel portion to pass through corresponding ribs. With such a structure, uniform prestressing may be applied to the chord.

Anther aspect of the present invention is directed to a roof framing using trussed girders as recited in claims 1, 2, 3 or 4. The roof framing further includes jointing members for jointing upper chord and lower chord of two adjacent trussed girders to form a roof framing unit, and the roof framing unit is provided in a plurality.

Still another aspect of the present invention is directed to a method of constructing a roof framing of a building using trussed girders according to claim 1. The method comprises the steps of: (a) constructing a base in the vicinity of one end of each of parallel structural members having upper edges to extend perpendicularly between the structural member; (b) assembling a first trussed girder and a second trussed girder on the base to be each in a vertical plane perpendicular to the structural members, the first and second trussed girders having a length to extend between the structural members; (c) joining the first and second trussed girders to form a first roof framing unit; (d) moving the first roof framing unit longitudinally of the structural members over upper edges of the structural members for bridging the first roof framing unit between the structural members; (e) then, assembling a third trussed girder to be parallel with the second trussed girder, the third trussed girder having a length to extend between the structural members; (f) joining the third trussed girder to the second trussed girder of the first roof framing unit for forming a jointed roof framing; (g) moving the jointed roof framing longitudinally of the structural members over the upper edges of the structural members for bridging the jointed roof framing between the structural members in position; and (h) jointing the jointed roof framing bridged in position to the structural members for fixing the jointed roof framing. With such a construction, any extra large crane for lifting the roof framing and temporary works for the construction of the roof which the prior art necessitated are not necessary. Thus, the construction term and cost of the roof framing are reduced.

DETAILED DESCRIPTION OF THE PREFERRED EMBODIMENTS

Figure 2:
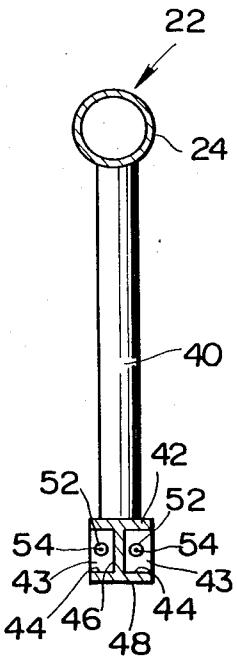
FIG. 2 is a cross-section taken along the line II—II in FIG. 1.
Figure 1:
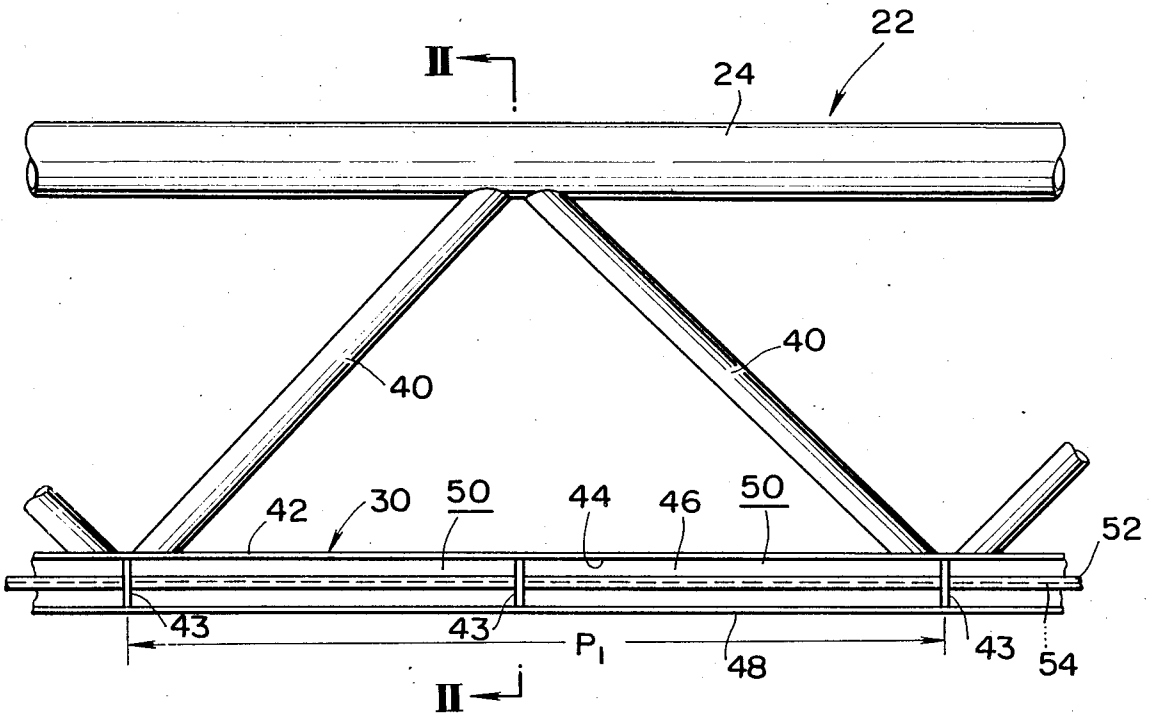
FIG. 1 is a front view of part of each trussed girder constructed according to the present invention.
Figure 3:
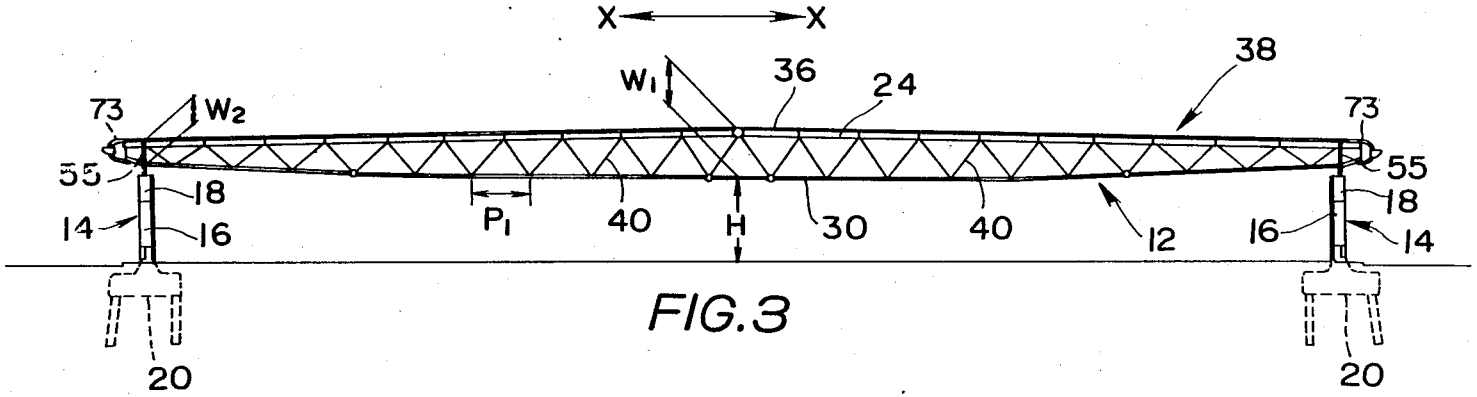
FIG. 3 is a front view with a modified scale of the roof framing using the trussed girders in FIG. 1.
Figure 4:
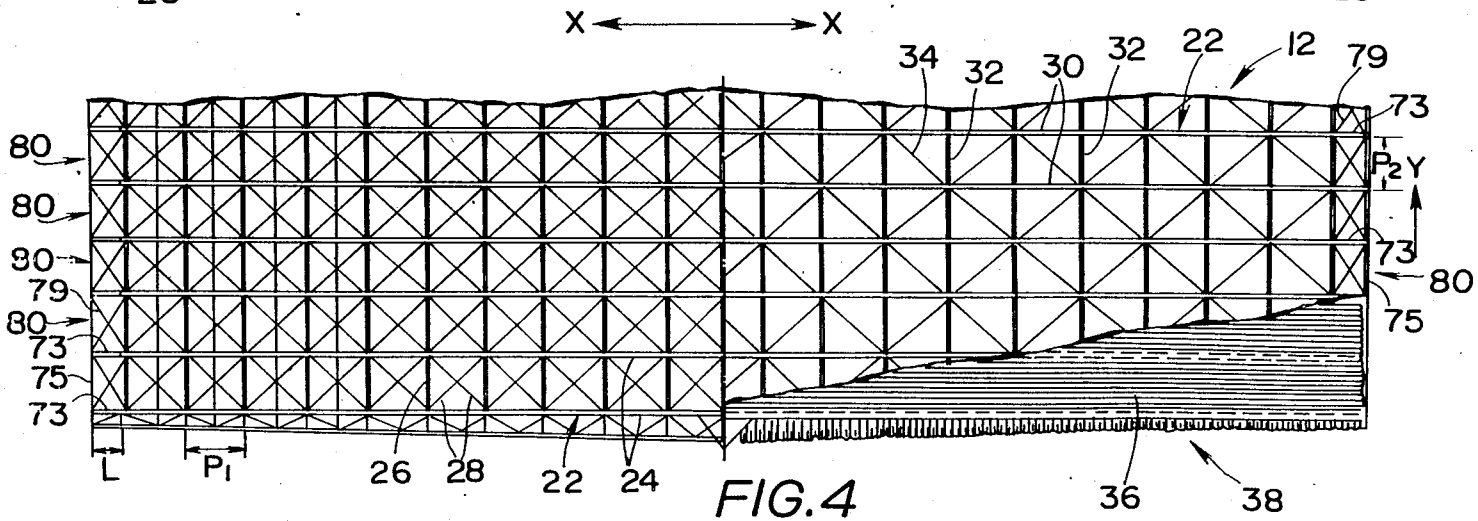
FIG. 4 is a plan view of the roof framing in FIG. 3.

FIGS. 3 and 4 illustrate a trussed steel roof framing 12 which spans between parallel structural elements 14 and 14, forming outer walls, in the direction X—X. Each structural element 14 has a framework including columns 16 spanned with wall girders 18 and is erected on a foundation 20.

Figure 5:
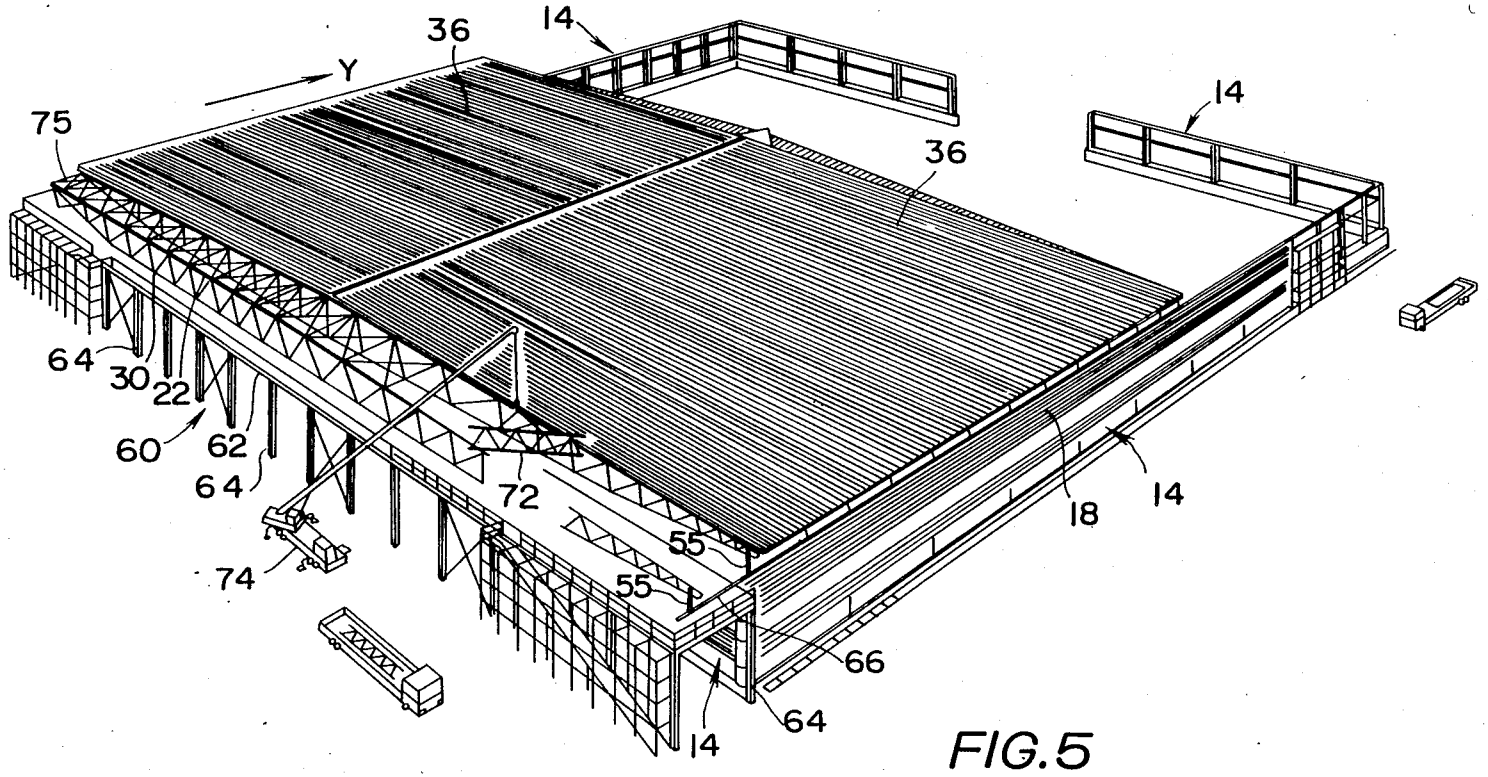
FIG. 5 is a perspective view of a building using the roof framing in FIG. 3.

The trussed roof framing 12 has a plurality of parallel trussed girders 22 jointed to adjacent trussed girders 22. FIGS. 4 and 5 show more detailed joint structure of the trussed girders 22. Upper cords 24 of two adjacent trussed girders 22 are jointed with twenty one horizontal joint members 26 of H steel at predetermined intervals and further connected with twenty bracings 28 made of angles as illustrated in FIG. 4. Lower chord 30 of two adjacent trussed girders 22 are jointed with twenty horizontal joint members 32 of H steel and nineteen bracings 34 of angles as shown. Each of upper chord 24 is made of a steel pipe and each lower chord 30 is made of a wide flange shape. The upper portion of the roof framing 12 are conventionally covered with roof plates 36 to form a roof 38.

Figure 7:
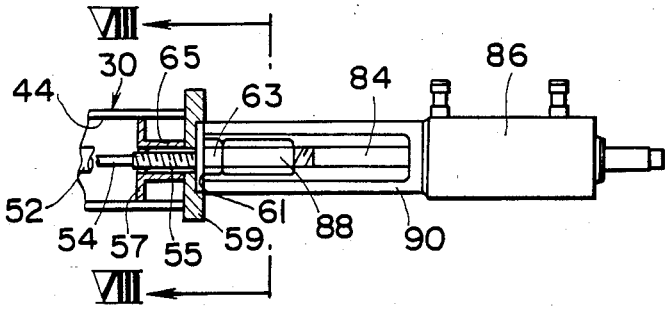
FIG. 7 is an enlarged view, partly in section, of part of the trussed girder in FIG. 3, demonstrating how to stretch the prestressing steel wire.
Figure 8:
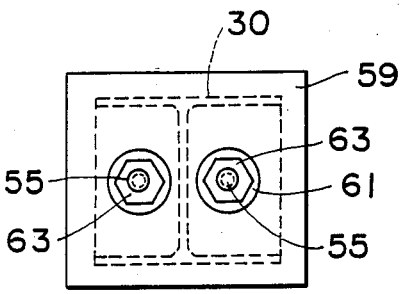
FIG. 8 is a view taken along the line VIII—VIII when the hydraulic jack unit is removed.

Each trussed girder 22 has a plurality of pipe lattice members 40, twenty lattice members in this embodiment, the lattice members 40 jointing the upper chord 24 to an upper flange 42 of the lower chord 30 in a conventional manner. The lower chord 30 has a multiplicity of ribs 43 welded to its parallel channel portions 44 and 44, to partition the channels 50 and 50 at predetermined intervals. The channel portions 44 and 44 are formed by inner faces of the upper and lower flanges 42 and 48 and opposite faces of the web 46. Each channel portion 46 has a steel sheath 52 passing through the ribs 43 to extend longitudinally between its opposite ends. The sheath 52 may be made of a polyvinyl chloride resin. A prestressing steel wire 54 passes through each of the sheath 52 and each prestressing steel wire 54 is covered at its opposite ends with respective threaded sleeves 55 which are attached to corresponding ends by conventional cold extrusion. Although only right end of the prestressing steel wire 54 is illustrated in FIG. 7, the sleeve 55 of each end of the wire passes through a supporting plate 57 welded to corresponding channel portion 44 near an associated end of the lower chord 30 and further passes through a hydraulic jack supporting plate 59 welded to that end. Then, each sleeve 55 passes through a washer 61 and is threaded with a nut 63. The supporting plate 57 and the hydraulic jack supporting plate 59 is jointed by a supporting pipe 65. After the upper and lower chord 24, 30 and lattice members 40 are jointed together and necessary finish materials such as roof plate 36 and facilities of the roof 38 are provided, the prestressing steel wires 54 are stretched under tension and then attached at its opposite ends to the opposite ends of the lower chord 30 as hereinafter described, so that prestress is applied to each trussed girder 22 by its prestressing steel wires 54. Each trussed girder 22 has a vertical I steel support member 51 jointed to its each end. More specifically, corresponding ends of the upper and lower chord 24 and 30 are jointed to respective support members 51 having a bottom end welded to a horizontal rectangular steel support plate 53 which has a thickness of 3.2 mm. The lower face of each support plate 53 has a Teflon plate 61 baked to it. The thickness of the Teflon plate 61 is 2.4.mm. Further, corresponding ends of the upper and lower cords 24 and 30 are jointed to a cantilever unit 73. Two adjacent cantilever units 73 are jointed with two horizontal steel joint members 75, 75 and four bracings 79.

Figure 6:
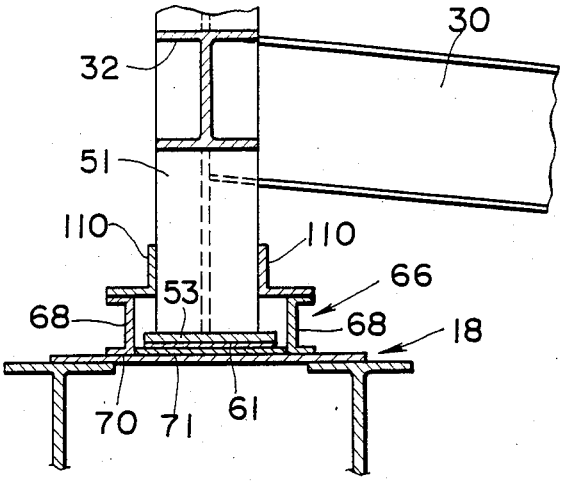
FIG. 6 is an enlarged view, partly in section, of part of the trussed girder in FIG. 3, illustrating the guide unit in FIG. 5.

FIG. 5 illustrates how to construct a building with a roof framing 12 according to the present invention. First of all, structural elements 14, as outer walls, are erected in a conventional manner. Next, a temporary base 60 is built adjacent to one end of each of parallel structural elements 14 and 14 so that it extends beyond outer faces of the structural elements 14 and 14 perpendicularly to them. The temporary base 60 includes a top plate 62 and a plurality of columns 64 supporting the top plate 62. The temporary base 60 is substantially equal in height to the parallel structural elements 14 and 14 and the width thereof is larger than the pitch $P_2$ of the trussed girders 22. On the upper face of each of the wall girders 18, there is mounted a guide unit 66 to extend to the top plate 62 of temporary base 60 although only one guide unit 66 is shown in FIG. 5. Each guide unit 66, as illustrated in FIG. 6, includes a pair of channel members 68 and 68 bolted to a top plate 70 of a corresponding wall girder 18 in a equi-spaced manner. An elongated stainless steel plate 71, having a thickness 2 mm, is mounted by welding on each of the top plates 70 between the two channel member 68 and 68 so that it extend along the associated guide unit 66.

Prefabricated components 72 for the roof framing 12 are lifted onto the top plate 62 of the temporary base 60 by means of a truck crane 74 and are assembled into a pair of trussed girders 22 with two pair of cantilever units 73, the trussed girders and cantilever units being jointed with horizontal members 26, 32 and 75 and bracings 28 34 and 79 as previously described. A roof framing unit 80 is thus formed. Two pairs of vertical support members 51, 51, 51, 51 are, as clearly shown in FIG. 6, fitted at their bottom ends in corresponding guide units 66 so that Teflon plate 61 of each support member 51 is brought into contact with the stainless steel plate 71 of the guide unit 66. The contact between stainless steel plates 71 and Teflon plates 61 produce very small friction. Then, the roof framing unit 80 thus assembled is covered with elongated roof plates 36 so that two adjacent roof plates 36, 36 are overlapped each other and is provided with other components such as illumination appliances. Thereafter, the two prestressing steel wire 54 and 54 of each trussed girder 22 are simultaneously stretched for applying prestress to them, in which the sleeve of the right-hand end of each prestressing steel wire 54 is connected to a tension rod 84 of a center-hole-type hydraulic jack 86 through a tension coupler 88 in a threaded manner and then tension is applied to the prestressing steel wire 54 by actuating the hydraulic jack 86. When sufficient tension is applied, associated nuts 63 are turned for securing each wire 54 under appropriate tension between opposing supporting plates 59 and 59. Thereafter, couplers 88 are disconnected from the sleeves 55 for removing each of hydraulic jacks 86. The reference numeral 90 designates a ram chair placed on the washer 61. In this embodiment, F-type hydraulic jacks for conventional SEEE method are used as the jack 86. Thus, a roof framing unit 80 is completed.

Figure 9:
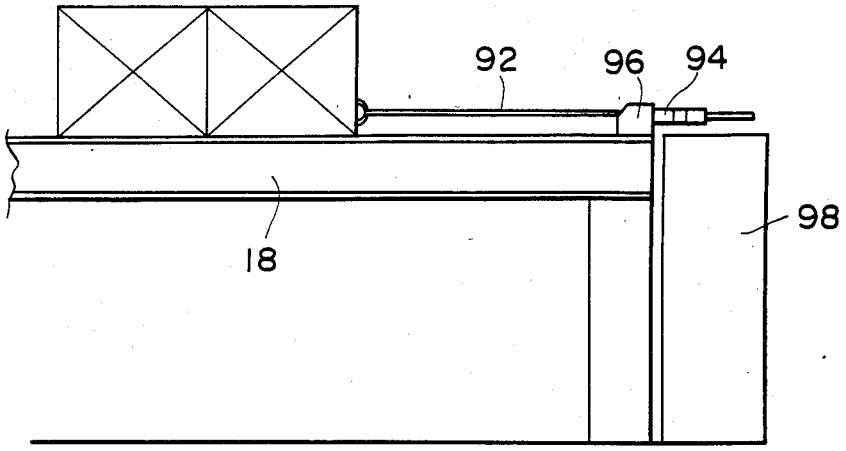
FIG. 9 is a diagrammatical view demonstrating how to pull the roof framing in FIG. 5.
Figure 10:
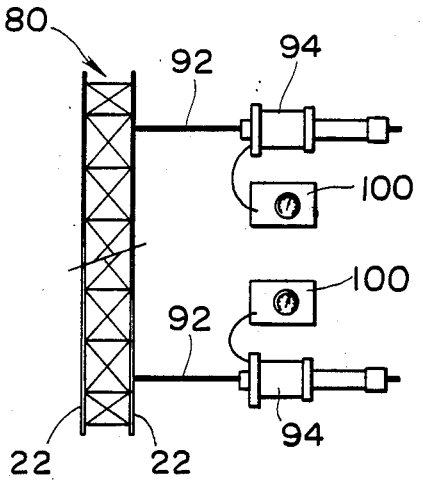
FIG. 10 is a diagrammatic illustration of the hydraulic jack units used in pulling the roof framing in FIG. 5.
Figure 11:
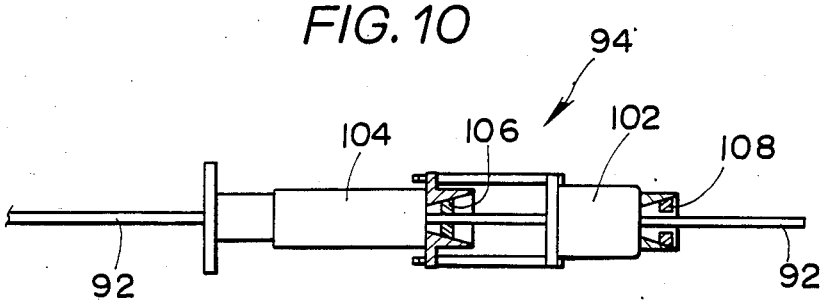
FIG. 11 is an enlarged view of each hydraulic unit in FIG. 10.

Then, the roof framing unit 80 is moved one pitch $P_2$ (FIG. 4) in the direction Y so that it is placed on the wall girders 18 and 18. For completing this operation, each end portion of the leading trussed girder 22 is, as shown in FIGS. 9 and 10, connected through a steel wire rope 92 to a conventional center-hole-type slide jack unit 94, which is supported on a jig 96 mounted on forward end of the wall girder 18. Provided near the forward end of the wall girder 18 is a supporting base 98 for hydraulic pumps 100 and 100 of the jack units 94 and 94. FIG. 11 illustrates a more detailed construction of each jack unit 94, which includes a hydraulic jack 102 and an oil damper 104 jointed to the jack 102 and has a retaining collet 106 and a clamping collet 108 for clamping the rope 92 for pulling it. When the ropes 92 are pulled, the retaining collets 106 are released and the clamping collets 108 are moved forwards clamping the rope 92 and when the rope 92 is retained, the clamping collets 108 are released and the retaining collets 106 clamps the ropes 92. By actuating the jack units 94 and 94 the roof framing unit 80 is moved forwards in a stepwise manner.

Subsequently, another trussed girder 22 with a pair of cantilever units 73 and 73 is assembled on the temporary base 60 and then, jointed to the adjacent trussed girder 22 through bracings 28, 34 and 79 and horizontal members 26, 32 and 75 to form a second roof framing unit 80 in the same manner as the previous roof framing unit 80. After roof plates 36, etc are mounted on the second roof framing unit 80, two prestressing steel wires 54 are stretched in the same manner. Then, the jointed two roof framing units 80 and 80 are moved again one pitch P2 in the direction Y.

By repeating these operations, a roof is constructed to cover the structural elements 14. Then, vertical support members 51 are, as shown in FIG. 6, jointed to channel members 68 of associate guide unit 66 by welding angular members 110 to them for fixing the roof to the structural elements 14 and the temporary base 60 is removed from the building thus completed.

In the above described method, no indoor temporary works are needed for constructing the roof and necessary operations are made from the outside of the building. Thus, during construction of the roof, other operations may be carried out within the building, so that the construction term of the building is reduced. When a new roof is constructed for a building already built, additional framing unit may be assembled while part of an old roof already built is being removed.

The structure of the trussed girders 22 are conventional except the prestressing steel wires 54 are specifically mounted and hence they have sufficient strength to hold itself. Thus, should prestressing wires 54 be accidentally cut or disconnected form the trussed girders, there is little possibility of the girders being broken. Conventional materials may be used for components of the trussed girders.

A roof framing was constructed as one example and had the same structure and components as the roof framing 12 except that prestressing steel strands were used instead of the prestressing steel wires 54. The roof framing had the following specifications:

Span of the trussed girders 22: 100.0 m
Weight of each roof framing unit 80: 60 tons
Prestress applied to each prestressing steel strand: 70 tons
Long time deflection: 43 cm
Camber of the trussed girders 22: 27 cm
Effective height H: 7.00 m
Pitch $P_2$ of the girders 22: 5.00 m
Pitch P1 of the lattices 40: 5.00 m
Length of the cantilever units 73: 3.50 m
Thickness W1 of the intermediate portion of the girders 22: 3,900 mm
Thickness W2 of the opposite ends of the girders 22: 1,000 mm The size of components of each roof framing unit 80 were as follows:

Upper chord 24: 406.4 mm (outer diameter)×9.5 mm(thickness)
Lower chord 30: 300 mm×300 mm×10 mm×15 mm
Lattice members 40: 216.3 mm(outer diameter)×4.5 mm (thickness)
Horizontal members 26: 208 mm×124 mm×5 mm×8 mm
Horizontal members 32: 100 mm×100 mm×6 mm×8 mm
Bracings 28: 90 mm×90 mm×7 mm
Bracings 34: 90 mm×90 mm×7 mm
Prestressing steel strands: 12.7 mm (diameter)×12

The prestressing steel wire 10 may be attached to the upper chord 24 instead of the lower chord 30 or attached to both the upper and lower chord. In place of the prestressing steel wire 10, a prestressing steel strand or a prestressing steel rod may be used.

The trussed girder according to the present invention is not limited to the trussed girder 22 shown and described, but may adopt conventional structures if it has a prestressing steel member as described in the appended claims. The upper and lower cords and lattice members are not limited to pipes or wide flange shapes, but may be I-steel, T-steel or any steel member having a suitable shape. For wooden trussed girders, lumber members may be used for such structural members of the trussed girder.

The trussed girder of the present invention may be used for bridges and any other buildings other than the roof framing.

The method of constructing the trussed girder and the roof framing according to the present invention may be modified within the scope of the invention which is defined by the appended claims. For example, instead of the structural elements 14, wall elements of an building already constructed may be used.

What is claimed is:

1. A trussed girder in which an upper chord and a lower chord are jointed through lattice members, each chord having opposite end portions, comprising:

a prestressing steel member;

attaching means for attaching opposite ends of the prestressing steel member to one of both the upper chord and the lower chord at opposite end portions of the one chord to longitudinally extend under tension so that prestress is provided to the trussed girder; and wherein the trussed girder has a central portion, wherein the trussed girder has the larger thickness WI at the central portion thereof and gradually reduced in its thickness toward opposite ends thereof.

2. A trussed girder as recited in claim 1, further comprising a sheath member, mounted on the at least one chord to extend longitudinally, the prestressing steel member passing through the sheath member.

3. A trussed girder as recited in claim 2, wherein the attaching means comprises; a pair of engaging members jointed to opposite ends of the prestressing steel member; and connecting means for connecting the engaging members to the at least one chord so that the tension of the prestressing steel member is adjustable.

4. A trussed girder as recited in claim 3, wherein the at least one chord comprising: an upper flange; a lower flange; a web joining the upper and lower flanges to define a pair of parallel channel portions; and ribs mounted thereon to partition the channel portions, and wherein the sheath member is mounted to the at least one cord in the number of two so that each sheath member is disposed in a corresponding channel portion to pass through corresponding ribs.

5. A roof framing using trussed girders as recited in claims 1, 2, 3 or 4, further comprising jointing members for jointing upper cords and lower cords of two adjacent trussed girders to form a roof framing unit, and wherein the roof framing unit is provided in a plurality.

6. A trussed girder as recited in claim 2, wherein the prestressing steel member is attached to the lower chord.

7. A trussed girder as recited in claim 1, wherein the lower chord is arched to be convex downwards.

8. A method of constructing a roof framing of a building using trussed girders according to claim 1, comprising the steps of:

(a) constructing a base in the vicinity of one end of each of parallel, vertical structural members, having upper edges, to extend perpendicularly between the structural members, said base having a top face substantially equal in level to the upper edges of the structural members;

(b) assembling a first trussed girder and a second trussed girder on the base to be each in a vertical plane perpendicular to the structural members, the first and second trussed girders each having an upper chord and a lower chord, both the chords being long enough to span both the structural members;

(c) joining the first and second trussed girders to form a first roof framing unit;

(d) applying prestress to at least one of both the upper and lower chords of each of the first and second trussed girders;

(e) moving the first roof framing unit longitudinally of the structural members over upper edges of the structural members for bridging the first roof framing unit between the structural members;

(f) then, assembling a third trussed girder to be parallel with the second trussed girder, the third trussed girder having an upper chord and a lower chord, both the chords being long enough to span to the structural members;

(g) joining the third trussed girder to the second trussed girder of the first roof framing unit for forming a jointed roof framing;

(h) applying prestress to at least one of both the upper and lower chords of the third trussed girder;

(i) moving the jointed roof framing longitudinally of the structural members over the upper edges of the structural members for bridging the jointed roof framing between the structural members in position; and (j) jointing the jointed roof framing bridged in position to the structural members for fixing the jointed roof framing.

9. A method as recited in claim 8, wherein the first roof framing unit moving step (d) comprises the step of guiding the first roof framing unit longitudinally of the structural members, and wherein the jointed roof framing moving step (g) comprises the step of guiding the first roof framing unit longitudinally of the structural members.

10. A method as recited in claim 9, after the base construction step, further comprising the step of mounting a guide rail on the upper edge of each structural member along the upper edge to extend to the base for guiding the first roof framing unit and the jointed roof framing longitudinally of the structural members, wherein the first and second trussed girders assembling step (b) comprises the step of making the first and second trussed girders in slidable contact with the guide rail, and wherein the third trussed girder assembling step (e) comprises the step of making the third trussed girder in slidable contact with the guide rail.

11. A method as recited in claim 10, wherein the first and the second trussed girders jointing step (c) comprises the step of mounting first roof plate members on the first and the second trussed girders for coving the first roof framing unit, and wherein the third trussed girder joining step (f) comprises the step of mounting second roof plate members on the third trussed girder for covering the jointed roof framing.

12. A method as recited in claim 11, after the jointing roof framing moving step (g), further comprising the step of removing the base.

13. A method as recited in claim 12, before the first roof framing unit moving step (d), further comprising the step of removing part of a roof previously built on the structural members for moving the first roof framing unit, and before the jointed roof framing moving step (g), further comprising the step of removing another part of the previously built roof for bridging the jointed roof framing in position.

* * * * *